US008458982B2

(12) United States Patent
Smith, III

(10) Patent No.: US 8,458,982 B2
(45) Date of Patent: Jun. 11, 2013

(54) DUAL TENSION CONNECTOR

(75) Inventor: Dwight Burr Smith, III, Seattle, WA (US)

(73) Assignee: Dwight Burr Smith, III, Kirkland, WA (US)

( * ) Notice: Subject to any disclaimer, the term of this patent is extended or adjusted under 35 U.S.C. 154(b) by 82 days.

(21) Appl. No.: 13/050,859

(22) Filed: Mar. 17, 2011

(65) Prior Publication Data

US 2011/0272544 A1 Nov. 10, 2011

Related U.S. Application Data

(60) Provisional application No. 61/342,060, filed on Apr. 9, 2010.

(51) Int. Cl.
*E04B 1/24* (2006.01)
*E04B 1/26* (2006.01)

(52) U.S. Cl.
USPC ..... 52/715; 52/702; 248/228.1

(58) Field of Classification Search
USPC ..... 52/698, 704, 707, 708, 712, 715, 52/220.1, 702, 714, 271, 281, 282.1, 282.2, 52/282.3, 282.4, 285.1, 285.3; 248/200, 200.1, 248/205.1, 226.11, 227.11, 227.3, 227.2, 248/227.4, 228.1, 218.4, 219.1, 220.21, 220.22; 403/199, 187, 192, 217, 231, 205
See application file for complete search history.

(56) References Cited

U.S. PATENT DOCUMENTS

| | | | | |
|---|---|---|---|---|
| 6,415,575 | B1 * | 7/2002 | Thompson | 52/712 |
| 6,640,516 | B1 * | 11/2003 | Thompson | 52/712 |
| 6,662,517 | B1 * | 12/2003 | Thompson | 52/714 |
| 6,766,992 | B1 * | 7/2004 | Parker | 248/300 |
| 2004/0129845 | A1 * | 7/2004 | Whale et al. | 248/201 |
| 2005/0086897 | A1 * | 4/2005 | Roesset et al. | 52/698 |
| 2006/0260259 | A1 * | 11/2006 | Morse | 52/698 |
| 2008/0237421 | A1 * | 10/2008 | Szpotowski | 248/222.51 |
| 2009/0173036 | A1 * | 7/2009 | Hand | 52/715 |
| 2010/0205895 | A1 * | 8/2010 | Orchard | 52/712 |

* cited by examiner

*Primary Examiner* — William Gilbert
*Assistant Examiner* — Kyle Walraed-Sullivan

(57) ABSTRACT

The Dual Tension Connector (DTC) is a metal connector used for tying a wood or steel railing stanchion to a structural framing member. The DTC is designed to resist force applied to a railing stanchion in any direction. It is a one-piece solution for railing stanchion connections that requires no welding or separate washers. The DTC consists of a rectangular shaped section that can be attached to a structural framing member, and two elongated strap members located on each side of the rectangular shaped section. Each elongated strap has two seat members, and two triangular-shaped side members with seat members that are integrally connected. The seat members are located in such a manner so they may be folded, and locked together to act as one unit in resisting tension forces applied to the DTC.

1 Claim, 6 Drawing Sheets

Perspective View of Folded DTC

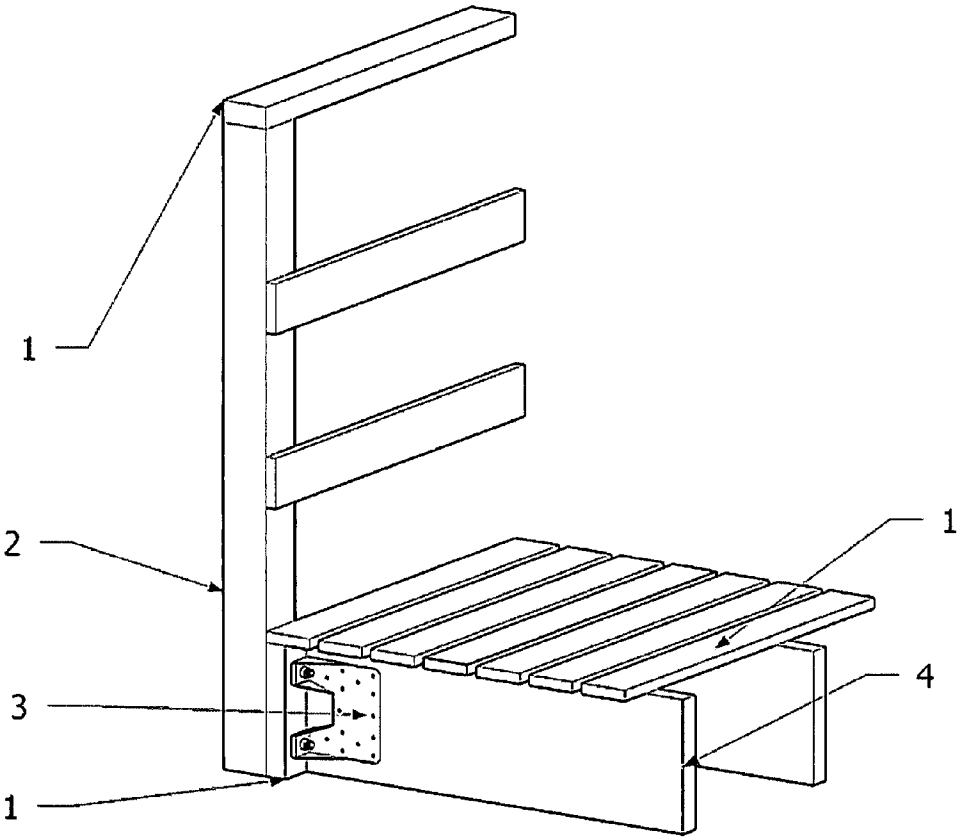
Figure 1: Perspective View of Installed DTC

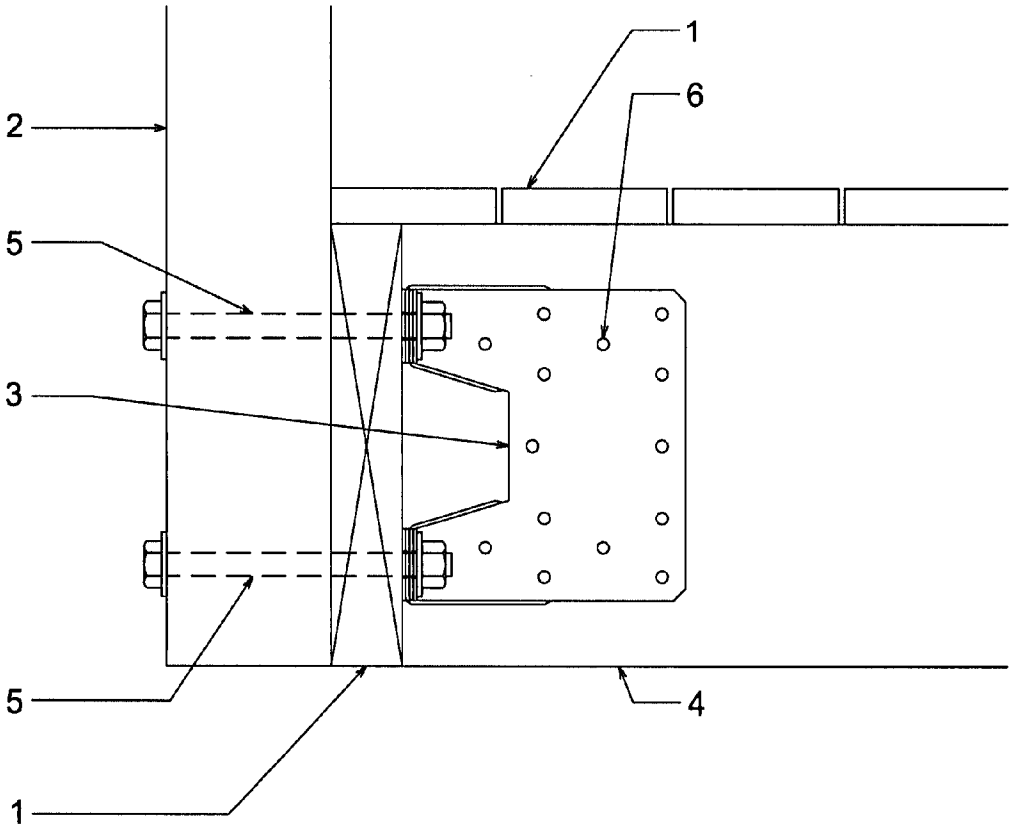
Figure 2: Close up Side View of Installed DTC

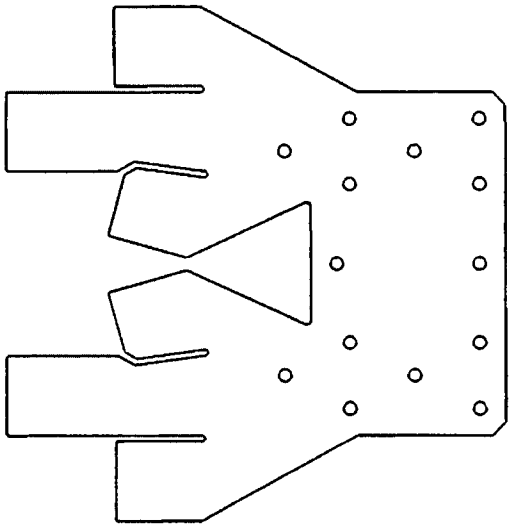
Figure 3: Top View of DTC as a Flat Plate

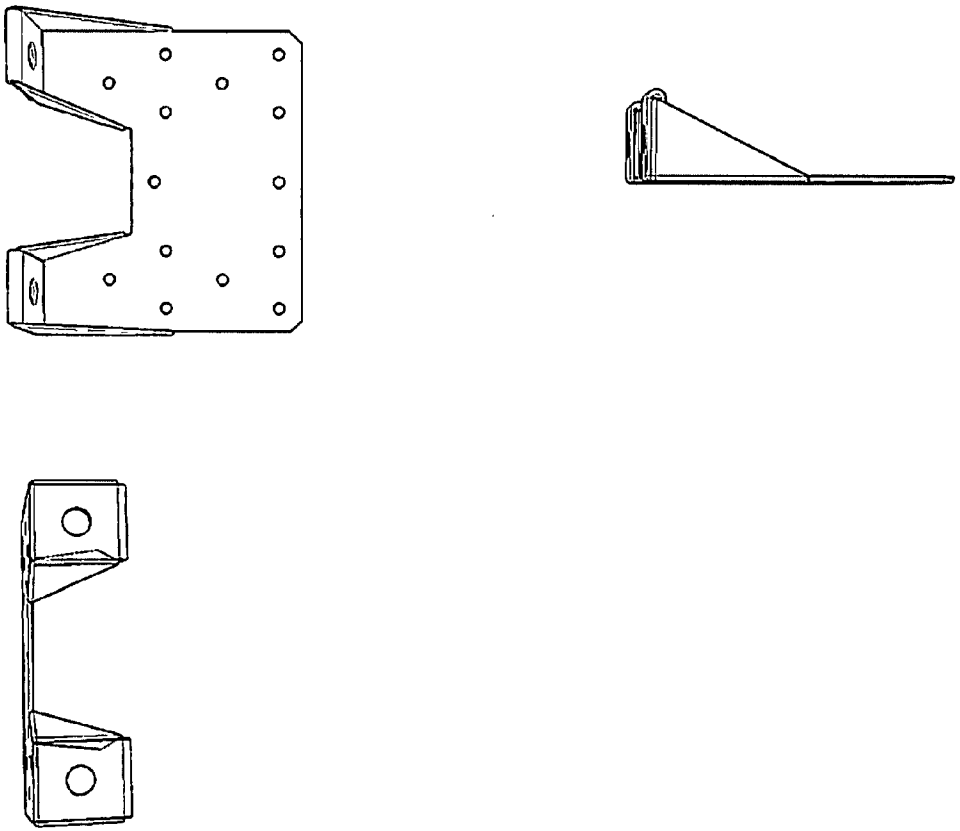
Figure 4: Top, Side, and Front View of Folded DTC

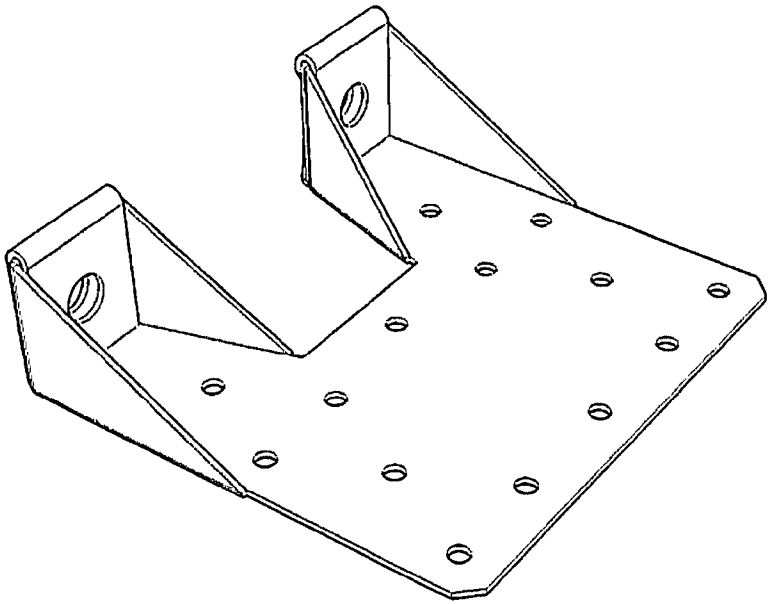
Figure 5: Perspective View of Folded DTC

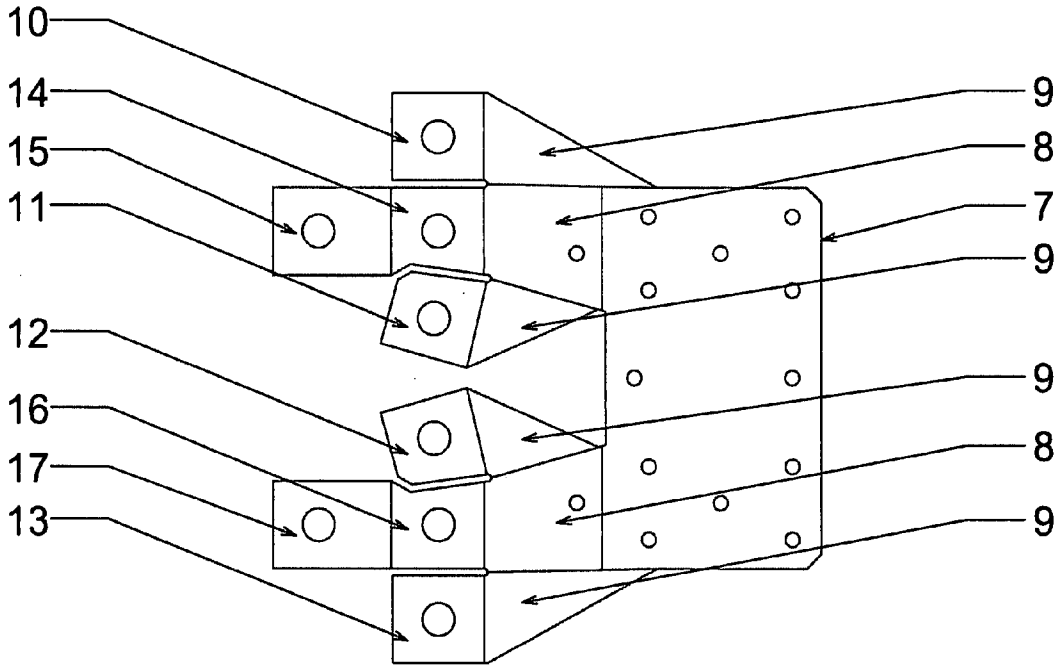
Figure 6: Top View of DTC as a Flat Plate with Labeled Members

DUAL TENSION CONNECTOR

This application claims the benefit of a prior filed provisional application, with application number provided below, 61/342,060

SPECIFICATION

The DUAL TENSION CONNECTOR (DTC) (3) is a metal connector used for tying a wood or steel railing stanchion (2) to a structural framing member (4). The DTC is designed to resist force applied to a railing stanchion by people or other objects in any direction. The DTC is used in conjunction with the connectors and fasteners used in standard building practice. Larger forces may be resisted with larger size DTC's. What sets this metal connector apart from other connecting ties is that it is a one-piece solution for railing stanchion connections that complies with current 2009 International Building Code requirements. FIG. 1 shows a perspective view of a DTC installed on a section of typical deck framing (1). FIG. 2 shows a close-up side view of the installed DTC in typical deck framing.

The DTC is a single connector requiring no welding or separate washers. It is designed to be manufactured efficiently from a single piece of metal plate. The DTC consists of a rectangular member (7) that can be attached to a structural framing member, and two elongated strap members (8) on each side of the rectangular shaped section. The first elongated strap member is connected to the fifth seat member (14), and the sixth seat member (15). The second elongated strap member is connected to the seventh seat member (16) and the eighth seat member (17). Each elongated strap has two triangular-shaped side members (9) with seat members. The first side member is connected to the first seat member (10). The second side member is connected to the second seat member (11). The third side member is connected to the third seat member (12). The fourth side member is connected to the fourth seat member (13). The inner triangular-shaped side is angled slightly towards the center of the connector. FIG. 3 shows a top view of the DTC as a flat metal plate and the shape and locations of all members described.

Each triangular-shaped side of the elongated strap members is designed to be folded in at 90 degrees toward the same side of the center elongated strap. The small rectangular section of each triangular-shaped side member is then folded in at 90 degrees toward the other side member, so that each side member's flat seat sections are adjoining. The center elongated strap is then folded around the two triangular-shaped side member seats by first bending at 90 degrees toward the seat members, then bending at 180 degrees around the seat members; thus forming a total of four adjacent seat members. FIG. 4 shows the DTC from the top, side, and front views with both elongated strap members and triangular-shaped side members folded into place. FIG. 5 shows a perspective view of the DTC in the same state.

Each seat members has a single hole in the middle that allows for a threaded rod, or other tension fastener (5), to be passed through and connected with a nut. Each elongated and folded strap member is designed to resist tension forces imposed on it by the threaded rod or tension fastener through the middle of the seat members. These forces are then transmitted to the framing member through the rectangular section of the DTC using screw, nail, or shear fastener means (6).

FIGURE DESCRIPTIONS

FIG. 1: Perspective View of Installed DTC
FIG. 2: Close Up Side View of Installed DTC FIG. 3: Top View of DTC as a Flat Plate
FIG. 4: Top, Side, and Front View of Folded DTC
FIG. 5: Perspective View of Folded DTC
FIG. 6: Top View of DTC as a Flat Plate with Labeled Members

I claim:

1. A single piece dual tension connection for tying a wood, or steel structural railing member at two locations to a wood, or steel structural frame member comprising:

a. a rectangular member having a top edge, a bottom end, a front face, a rear face, and first and second side edges;

b. first and second elongated strap members having a front face, a rear face, bottom end and top ends, first and second spaced side edges, wherein the first elongated strap member has its first side edge align with the first side edge of said rectangular member, and the second elongated strap member having its second side edge align with the second side edge of said rectangular member, and both elongated strap members having a top end that aligns with the bottom end of said rectangular section;

c. first, second, third, and fourth side members having generally triangular shapes and the second and third side members are slightly angled toward the center of the said rectangular member, wherein the first and second side members are integrally connected by a generally 90 degree bend line to a portion of said first and second side edges, respectively, of said first elongated strap member; the third and fourth side members are integrally connected by a generally 90 degree bend line to a portion of said first and second side edges, respectively, of said second elongated strap member;

d. a first seat member integrally connected to a bottom portion of said first side member along a first seat generally 90 degree bend line and formed with a first seat opening therethrough;

e. a second seat member integrally connected to a bottom portion of said second side member along a second seat generally 90 degree bend line for overlapping registration with said first seat member and formed with a second seat opening therethrough located for general registration with said first seat opening;

f. a third seat member integrally connected to a bottom portion of said third side member along a third seat generally 90 degree bend line and formed with a third seat opening therethrough;

g. a fourth seat member integrally connected to a bottom portion of said fourth side member along a fourth seat generally 90 degree bend line for underlapping registration with said third seat member and formed with a fourth seat opening therethrough located for general registration with said third seat opening;

h. a fifth seat member integrally connected to a bottom end of said first elongated strap member at a generally 90 degree bend line for underlapping said first and second seat members and formed with a fifth seat opening therethrough located for general registration with said first and second seat openings;

i. a sixth seat member integrally connected to said fifth seat member at a sixth seat bend line for overlapping said first, second and fifth seat members and formed with a sixth seat opening therethrough located for general registration with said first, second, and fifth seat openings;

j. a seventh seat member integrally connected to said bottom end of said second elongated strap member at a generally 90 degree bend line for underlapping said third and fourth seat members and formed with a seventh seat opening therethrough located for general registration with said third and fourth seat openings;

k. an eighth seat member integrally connected to said seventh seat member at an eighth seat bend line for overlapping said third, fourth and seventh seat members and formed with a eighth seat opening therethrough located for general registration with said third, fourth, and seventh seat openings;

l. a shear fastener means for insertion through said rectangular member for connection to said structural frame member;

m. a first tension fastener means for insertion through said first, second, fifth and sixth seat openings for first attachment of said single piece dual tension connection to said structural railing member; and n. a second tension fastener means for insertion through said third, fourth, seventh and eighth seat openings for second attachment of said single piece dual tension connection to said structural railing member.

* * * * *